US005490364A

United States Patent [19]

Desai et al.

[11] Patent Number: 5,490,364

[45] Date of Patent: Feb. 13, 1996

[54] TELESCOPIC FLARE PIPE TOWER

[75] Inventors: Vinod Desai; Richard E. Tesch, both of Houston, Tex.

[73] Assignee: Dreco, Inc., Houston, Tex.

[21] Appl. No.: 298,401

[22] Filed: Aug. 30, 1994

[51] Int. Cl.[6] ..... E04H 12/00

[52] U.S. Cl. ..... 52/637; 52/121

[58] Field of Search ..... 52/637, 121; 166/360, 166/77.5, 79, 85, 94; 29/283.1

[56] References Cited

U.S. PATENT DOCUMENTS

| | | | |
|---|---|---|---|
| 926,925 | 7/1909 | Carmony | 52/637 |
| 1,644,499 | 10/1927 | Trout | 52/637 |
| 2,496,532 | 2/1950 | Gross | 52/637 |

*Primary Examiner*—Carl D. Friedman
*Assistant Examiner*—W. Glenn Edwards
*Attorney, Agent, or Firm*—Lalos & Keegan

[57] ABSTRACT

A telescopic flare pipe tower supports a flare pipe several hundred feet above the base level and includes a bottom section in contact with the base that may be the ground or the platform or deck offshore. The bottom section has a door or opening through which tower section assemblies including a tower section and a flare pipe section are transported on a dolly travelling on a track and telescopically raised above the bottom section. Each tower section assembly includes a flare pipe that permits vertical movement relative to the tower section but substantially restricts lateral movement. Upon installation of the second tower section assembly below the superposed previously telescoped tower section assembly the flare pipe section may be raised by a jack positioned on the ground, the deck or other base level to move the flare pipe section up to the superposed flare pipe section for welding.

The method of erecting the telescopic flare pipe tower utilizes the track system with the dolly carrying the tower section assemblies into the bottom section. Each tower section assembly then may be telescopically raised in serial sequence. The flare pipe section is raised by a hydraulic jack to permit welding of the flare pipe sections to form a flare pipe.

36 Claims, 16 Drawing Sheets

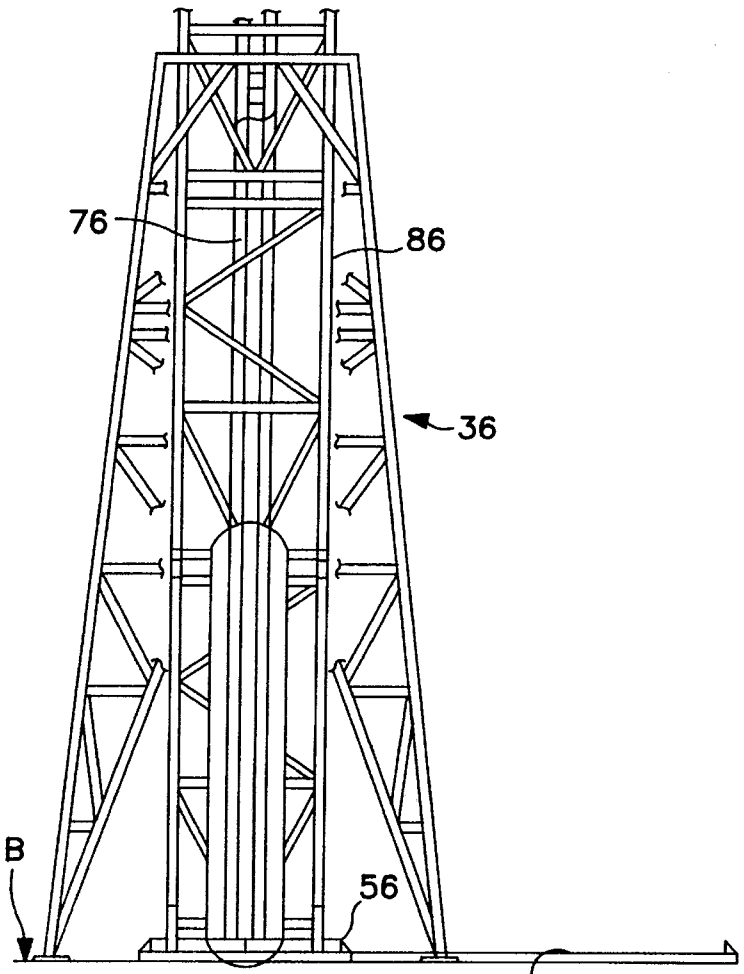
FIG. 9
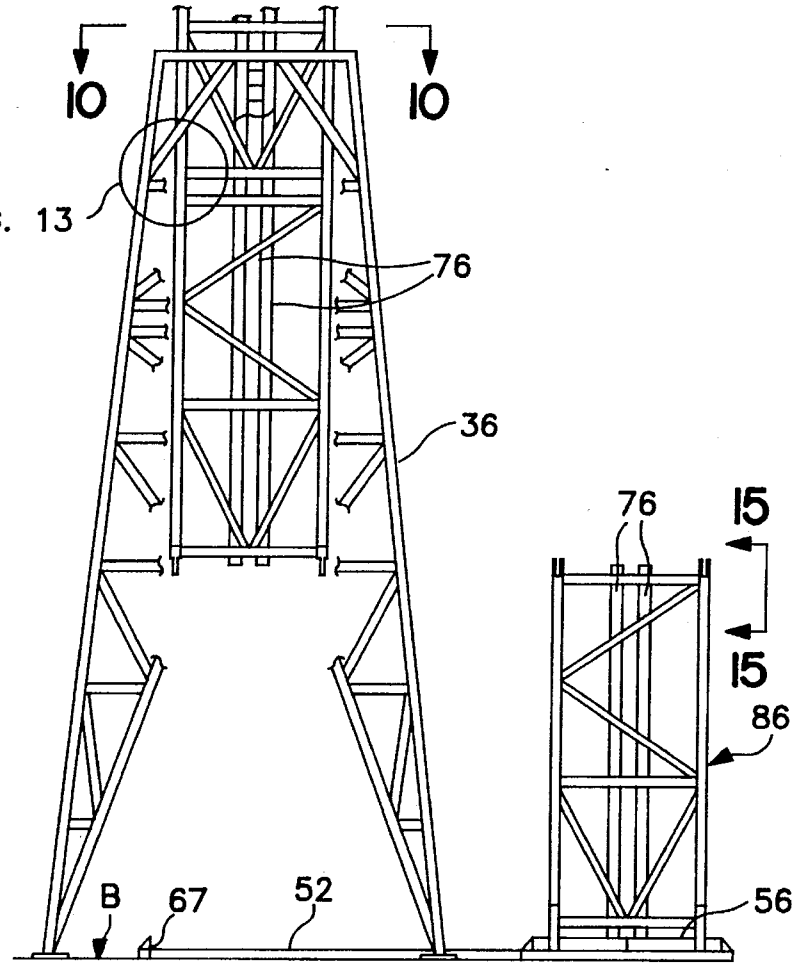
FIG. 8
FIG. 13

TELESCOPIC FLARE PIPE TOWER

INTRODUCTION

This application relates to flare pipes for the burning of excess or waste gases. More particularly the present invention relates to a flare pipe tower structure and the method of construction of such a tower. Additionally and significantly the present invention relates to the use of telescopic members for construction of the flare pipe tower.

BACKGROUND OF THE INVENTION

Flare pipes that burn at their tip end waste gases or other inflammables are required to be of greater height than in previous years in order to minimize any adverse effect of the heat and radiation upon personnel and equipment. Flare pipes of 300 feet or more are frequently required and their construction has posed serious problems for those in the industry.

Typically, flare pipe towers in the past have been tubular, welded one piece constructed section by section by being built from the ground or platform upwardly as each section is placed on top of the previous section. As is readily understood because of the height requirement for flare pipe towers, the crane required to raise the top most sections must itself be well over 300 feet making the construction very difficult if not impossible because of the expensive requirements of such a high crane and particularly when such a flare tower is to be installed in less than easily accessible places such as offshore. The flare pipe tower as understood must be usable either offshore on a platform or deck or on land where the flare pipe tower is resting on a base or other support.

OBJECTS OF THE INVENTION

Accordingly it is an object of the present invention to provide a flare pipe tower that is easily constructed and safely usable in a wide variety of locations and weather conditions.

A further object of the present invention is the telescopic construction of the flare pipe tower utilizing tower section assemblies that include a pipe section secured within the tower section.

A further object of the present invention is to introduce the tower section assemblies into a bottom section resting on a bore for telescoping upwardly to form the tower and the included flare pipe.

It is a still further object of the present invention to provide the transportation system including a dolly travelling on a track to transport additional tower section assemblies into the bottom section resting on a base that could be the platform or ground.

A further object of the present invention is the provision of a flare pipe section support means that permits vertical sliding movement but limits lateral motion of the foare pipe section.

A further object of the present invention is to raise the flare pipe section in alignment with previously installed flare pipe sections and relative to the tower section to align the flare pipe for welding.

Another object of the present invention is to provide a lower section that is placed within the bottom section and connected to as well as supporting the weight of the previously installed tower sections and which lower section is tapered downwardly to contact the deck or ground within a significantly smaller area than the cross-sectional area of the top of the lower tower section or the bottom of the tower sections in order to provide additional support for the flare pipe tower beyond that of the bottom section.

A still further object of the present invention is to provide a transportation system including a dolly and track arrangement for transporting tower section assemblies to and into the V-shaped opening in the bottom section.

These and other objects will be apparent from the study of the present invention as outlined in the following specification and claims.

DESCRIPTION OF THE DRAWINGS

FIG. 8 is a side view partly broken away of the sequence of installation wherein mast or tower section assemblies T1 and T2 have been telescopically raised and next intermediate mast section T3 on the dolly is poised for admittance to the bottom section.

FIG. 9 is a side view similar to that of FIG. 8 and also partly broken away illustrating the receipt of mast or tower section T3 on the dolly for subsequent connection.

SUMMARY OF THE INVENTION

A telescopic flare pipe tower supports a flare pipe several hundred feet above the base level and includes a bottom section in contact with the base that may be the ground or the platform or deck offshore. The bottom section has an opening on one side that forms a door or opening. Tower section assemblies that include a tower section and a flare pipe section are transported on a dolly travelling on a track into the center of the bottom section and telescopically raised above the bottom section. Each tower section assembly includes a flare pipe and a securing means that permits relative vertical movement of the flare pipe section relative to the tower section but substantially restricts lateral movement. Upon installation of the second tower section assembly below the superposed previously telescoped tower section assembly the flare pipe section may be raised by a jack positioned on the ground, the deck or other base level to move the flare pipe section up to the superposed flare pipe section for welding.

The method of erecting the telescopic flare pipe tower utilizes the track system with the dolly carrying the tower section assemblies into the bottom section. Each tower section assembly then may be telescopically raised in order to subsequently retrieve the dolly along the guide tracks for use in mounting the next tower section assembly in serial sequence. After the second tower section assembly has been connected to the top most tower section assembly and both tower section assemblies raised to permit the withdrawal of the dolly to set the tower section assemblies down to the ground, deck or platform, the flare pipe section is raised by a hydraulic jack to permit welding of the flare pipe sections to form a flare pipe. After the last tower section assembly has been installed and telescopically raised a lower section is installed below the superposed tower section assemblies for providing vertical support of the tower at a point within an area substantially reduced from the cross-sectional area of the tower.

DESCRIPTION OF THE PREFERRED EMBODIMENT

Figures 1A, 1B, 1C, 1D, 1E, 1F, 1G, 1H:
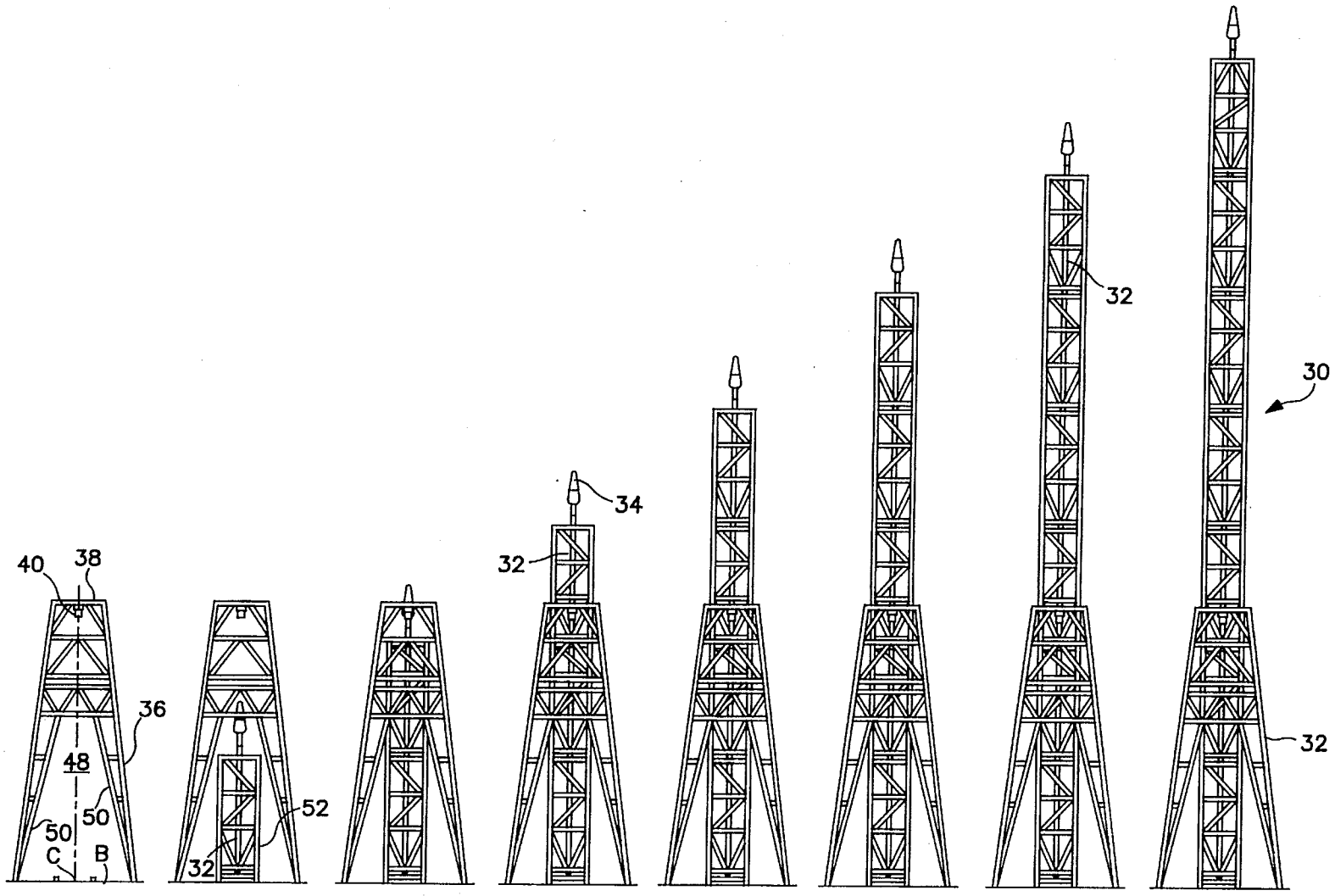
FIG. 1 is a side view of a portion of the sequence for the erection of the flare pipe tower.

In FIGS. 1 and 2 there is a schematic showing of the construction of the flare pipe tower as shown in FIGS. 1A through 1H of FIG. 1 and FIGS. 2A through 2E of FIG. 2. The completed flare pipe tower is shown at 30 of FIG. 1H and in FIG. 30. The completed flare pipe 32, is conventional and has an outlet or flare tip at 34 for the gases to be burned in an extended flame as is also conventional.

The flare pipe tower 30 of the present invention includes a bottom section 36 that can be best seen in the perspective views of FIGS. 3 through 7. Bottom section 36 includes four legs 36*a*, 36*b*, 36*c* and 36*d* that stand above a central location identified as C that may be at the level of base B on the ground if the flare pipe tower is to be assembled onshore at a ground installation or on a deck or platform of an offshore facility. Each leg 36*a* through 36*d* includes a longitudinal leg 37*a* through 37*d* respectively that extends from the base B forming the corners of the bottom section and are there angled inwardly and upwardly to the top 38 of the bottom section. The top of the bottom section is framed by horizontal braces 39 from which suitable lifting blocks 40 depend reeved with suitable lines 41 to winches 42 on the base level B. The four corners 44*a* through 44*d* respectively are provided with rollers 46 secured to the horizontal braces 39 in a suitable manner as shown. The rollers may be made of a suitable hard rubber and are orthogonally positioned relative to each other to assist in the telescopic raising of tower section assemblies through rolling contact therewith as shown in FIG. 1D411.

The bottom section, as readily apparent from the drawings, includes an opening or door 48 formed by angled support members 50. The opening 48 is to be high enough and wide enough to permit the entry of the tower section assemblies 86 as shown in FIGS. 1 and 2 and especially FIGS. 4 through 7 and as will be later described.

Figure 21:
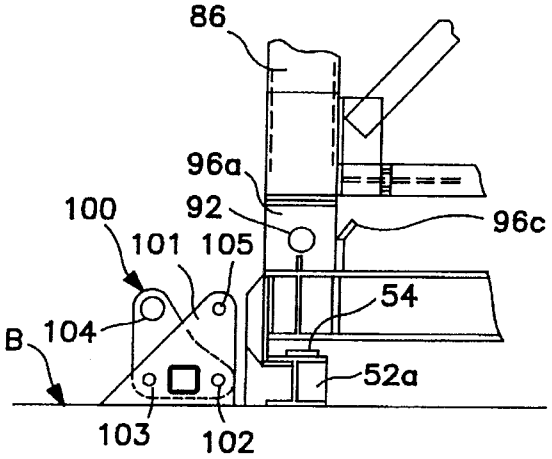
FIG. 21 is an enlarged fragmentary cross-sectional view of the detail identified as FIG. 21 in FIG. 19 and also illustrating the tie down latch in the unlatched position.
Figure 23:
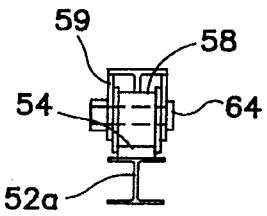
FIG. 23 is a fragmentary view of the tracking bar on the track beam upon which the flanged wheels with roller bearings move for transporting the dolly.
Figure 20:
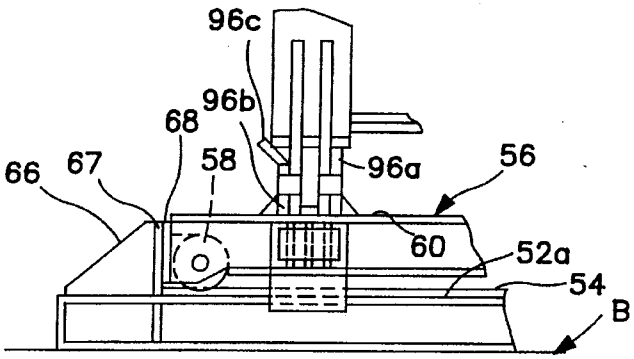
FIG. 20 is an enlarged fragmentary cross-sectional view in accordance with the circle shown as FIG. 20 in FIG. 19.

One of the features of the present invention is the use of guide tracks 52 which constitute a pair of rails 52*a* and 52*b* that are laid on the base B and extend from outside the bottom section 36 to a point beyond the approximate middle of the bottom section at C. The guide tracks are best shown in FIGS. 20, 21 and 23 to be formed from I beams that establish the rails 52*a* and 52*b*. Positioned on top of each of the rails is a tracking bar 54 that extends the length of the rail or track 52*a* and 52*b*.

Figure 19:
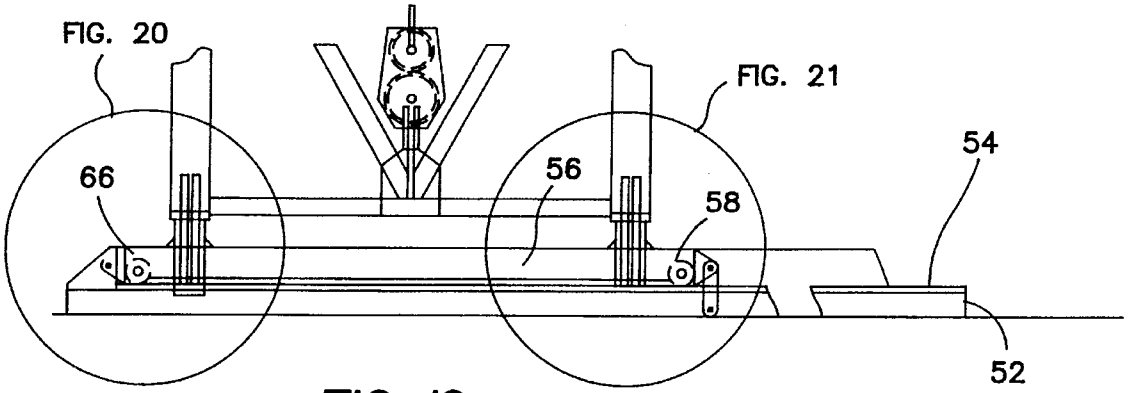
FIG. 19 is a side elevational view partly broken away of the dolly shown in position of FIG. 5 carrying the mast or tower section T1 and also illustrating the limit stop and the tie down for the dolly.

Designed to traverse the guide tracks 52 is a dolly 56 having a plurality of flanged wheels 58, as shown particularly in FIGS. 19 and 23. The dolly is formed from a plurality of horizontal beams supporting depending brackets 59 that hold the flanged wheels 58 for rotation in the conventional manner about axis 64. Dolly 56 as it traverses the guide tracks 52 is limited in its travel into the bottom section by a stop that has an abutment surface 67 to contact the foreward edge 68 of the dolly.

Figure 4:
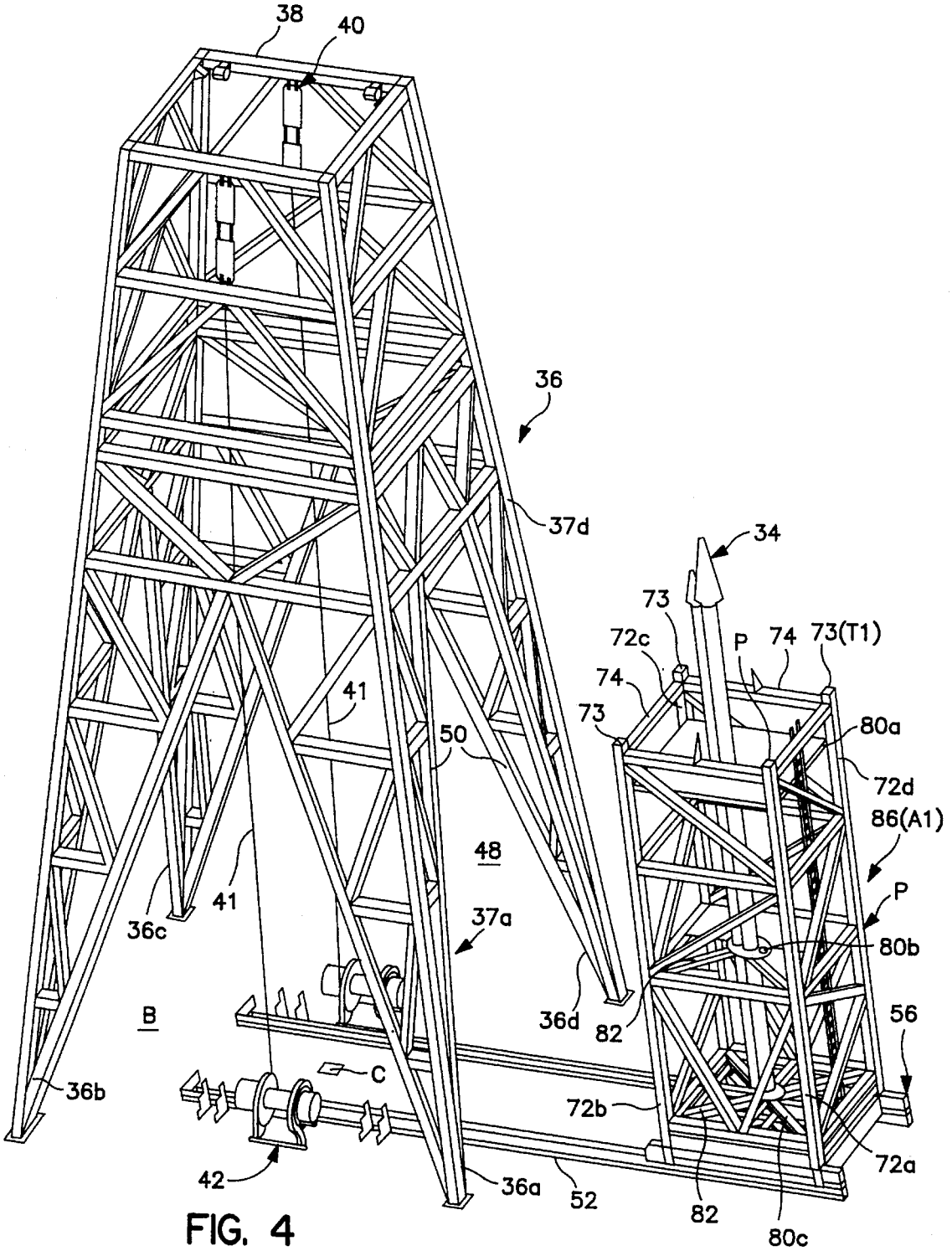
FIG. 4 is a perspective view similar to that of FIG. 3 but further along in the sequence for construction in that it discloses the top tower or mast section T1 positioned on the dolly for travel along the guide tracks through the V-shaped door opening in the bottom section.
Figure 5:
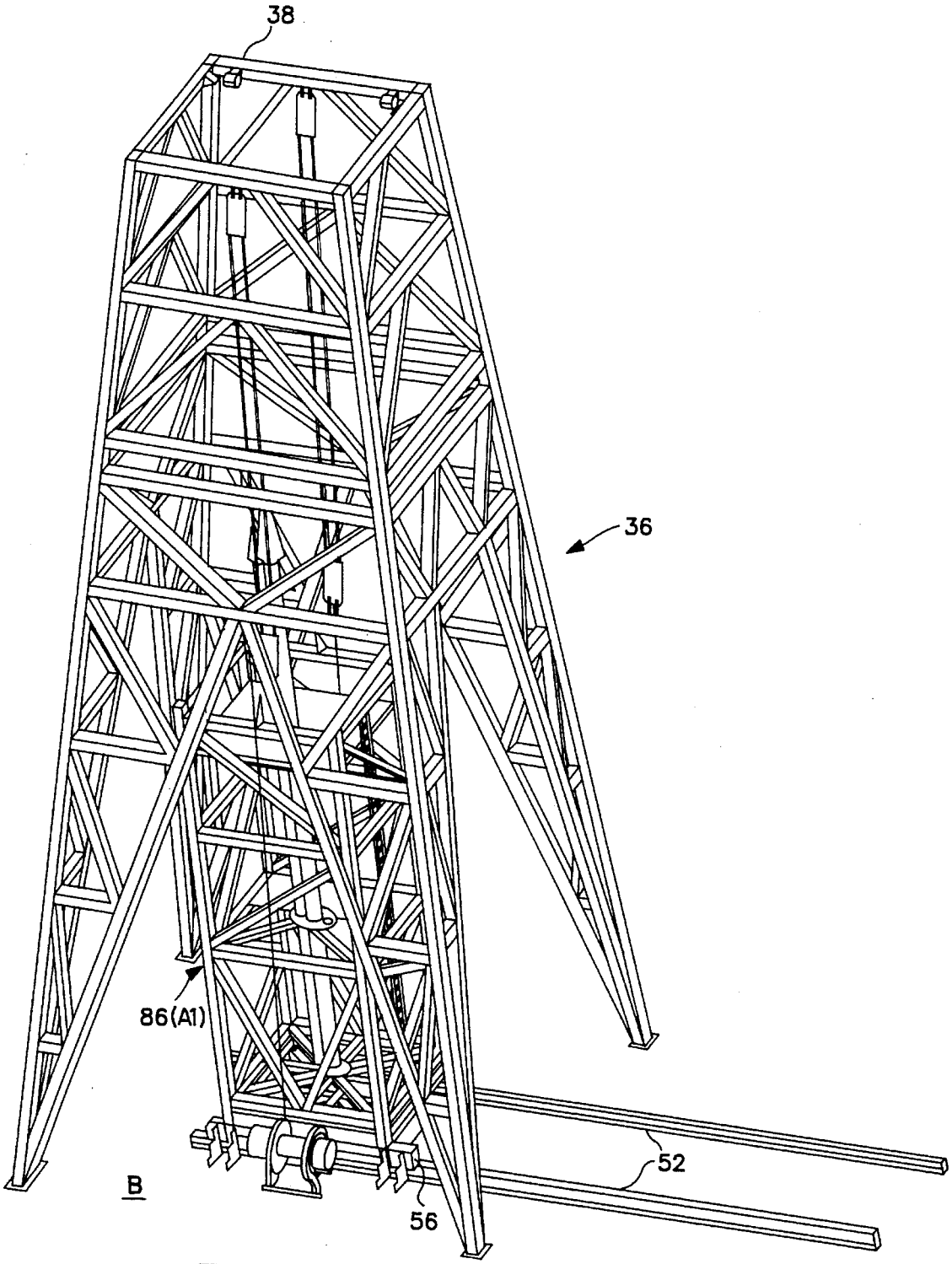
FIG. 5 is a view similar to FIG. 4 and further along in the sequence showing the dolly travelling through the V-shaped door of the bottom section and in position within the bottom section ready for telescopic raising
Figure 6:
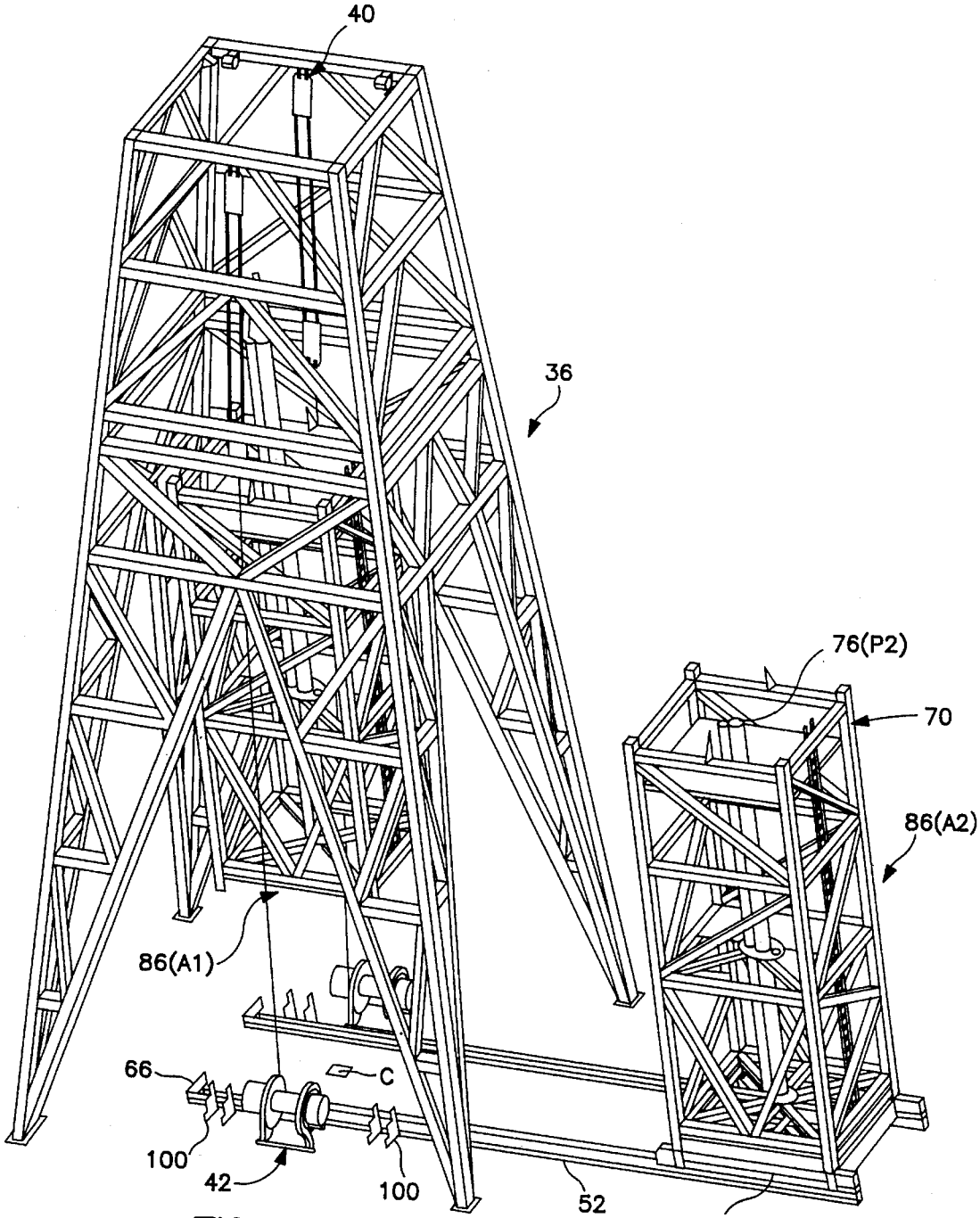
FIG. 6 is a perspective view similar to FIG. 5 and further along in the sequence wherein the mast section T1 is telescopically raised, the dolly has moved outwardly to receive new mast section T2.

As best shown in FIG. 1*b* and FIG. 4, the top tower or mast section T1 is shown at 70. Subsequent tower sections may be designated T2, T3, T4, etc. The tower or mast section 70 is similar in structure to all subsequent tower sections to be installed and telescoped subsequently as shown in FIGS. 1C through 1H and FIGS. 2A through 2E. The tower or mast section T1 is composed of four upright tower legs 72*a* through 72*d* secured together at corners 73 by a plurality of horizontal cross-members.

One of the unique features of the present invention is the inclusion of one or more flare pipe sections 76 within each tower section. The upper flare pipe section in the top most tower or mast section T1 may be referred to as P1. Later added flare pipe sections may be referred to as P2, P3, P4, etc. At the top of the flare pipe P1 is a flare tip 34 positioned at the flare pipe outlet. While several flare pipes and flare pipe sections 76 are shown in the drawing the following description will relate to only a single flare pipe, it being understood that each flare pipe or flare pipe section is constructed in a similar manner.

Figure 28:
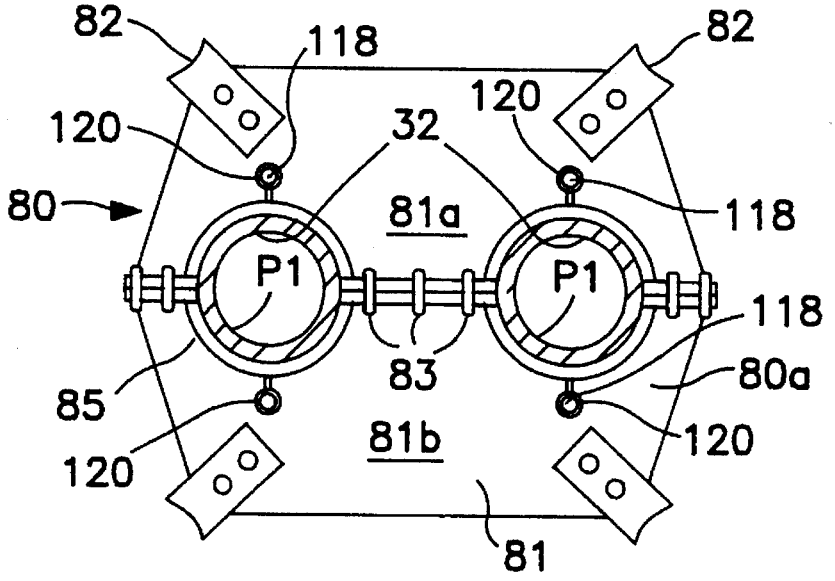
FIG. 28 is a cross-sectional view partly broken away taken along lines 28—28 of FIG. 26.
Figure 29:
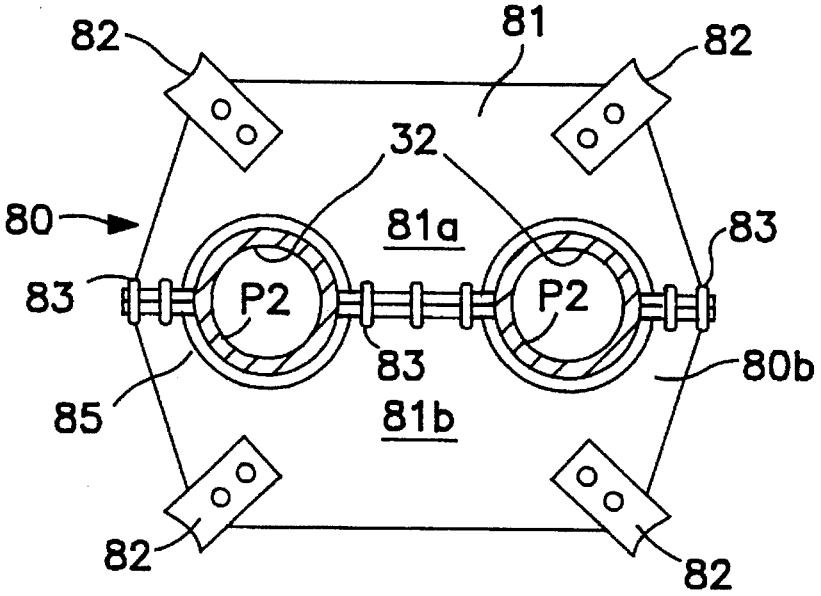
FIG. 29 is a cross-sectional view partly broken away taken along lines 29—29 of FIG. 26.

Another of the unique features of the present invention is the support 80 for the flare pipe sections as best shown in FIG. 4 and FIGS. 28 and 29. Each of the tower or mast sections 70 includes at least one of the supports 80 preferably more than one. As is shown in the drawings, particularly in FIG. 4 there are three such supports that may be identified as 80*a*, 80*b* and 80*c* reading from top to bottom. FIG. 28 is an illustration of the top most support 80*a* while FIG. 29 depicts the intermediate or lower support 80*b*. Support 80 is formed with a plate 81 held within the tower section 70 by four horizontal diagonals 82 that extend from plate 81 to the tower legs 72*a* through 72*d*.

As best shown in FIGS. 28 and 29 the plate 81 is formed from two halves 81*a* and 81*b* coupled together at 83 in a suitable manner by bolts through upturned edges 84.

To accommodate two flare pipes 32, the plates are each formed semicircular cutouts to create with suitable openings 85 that have a diameter large enough to permit the thermal expansion of the completed flare pipes during the passage of the heated gases but loose enough to permit vertical movement of the flare pipe sections when welded or partially welded together to move vertically relative to the plate 81 and therefore relative to the tower section 70. The purpose of each of the supports 80 is to limit the lateral or sidewise movement of the flare pipe 32 but to permit vertical movement for purposes to be disclosed hereinafter.

The unique combination of the flare pipe section P1 with the mast or tower section T1 is referred to as a tower or mast section assembly 86 or in series A1, A2, A3, etc. in that both the flare pipe section and the mast section are included in the one structure.

Each of the tower mast assemblies 86 and therefore each tower section 70 includes at least one platform P upon which workers may stand to perform duties such as welding the flare pipe sections together. In order to gain access to the platforms P a suitable ladder L with surrounding cage is positioned vertically on one side of the tower section.

Referring to the drawing, particularly FIGS. 4, 5, 6 and 7, it will be quite apparent that each tower or mast section assembly 86 is secured to the dolly 56 for transportation through the V-shaped opening or door 48 to be positioned over the center C within the bottom section 36.

Figure 16:
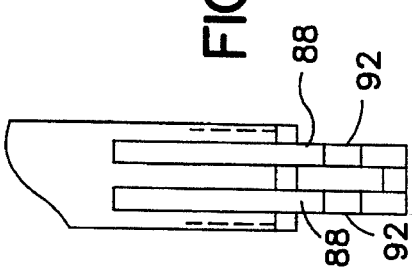
FIG. 16 is a fragmentary cross-sectional view taken along lines 16—16 of FIG. 8.
Figure 17:
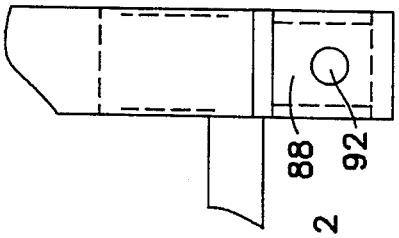
FIG. 17 is a side view of FIG. 16.
Figure 13:
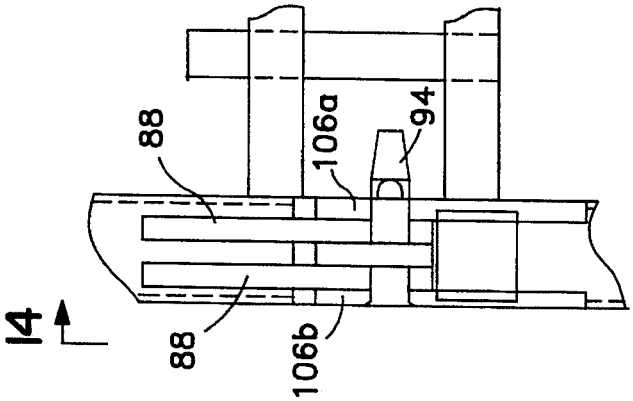
FIG. 13 is a magnified fragmentary cross-sectional view of the area shown and identified as FIG. 13 in FIG. 8
Figure 14:
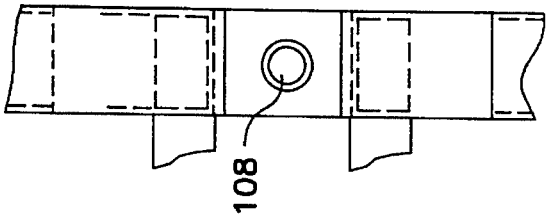
FIG. 14 is a side view taken along lines 14—14 of FIG. 13.
Figure 18A:
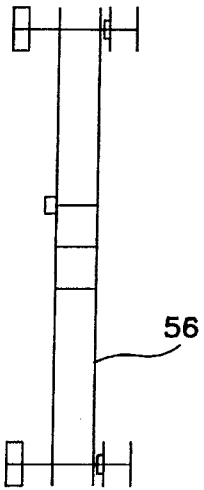
FIG. 18A is a side view of the dolly of FIG. 18.
Figure 18:
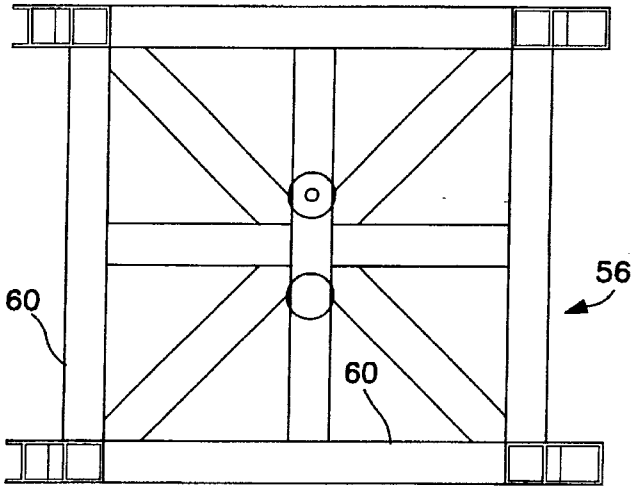
FIG. 18 is a plan view of the dolly.

The tower section assembly 86-A1 and therefore the tower section 70-T1 is provided with a pair of depending fingers as shown best in FIGS. 16 and 17 as well as FIGS. 20 and 21. These fingers identified as 88,88 are connected at their face by a connector pad 90 and each finger has a bore hole 92 that is mutually aligned for receipt of a pin 94 shown only in FIGS. 13 and 14 for the connection between adjacent superposed tower section assemblies.

Figure 22:
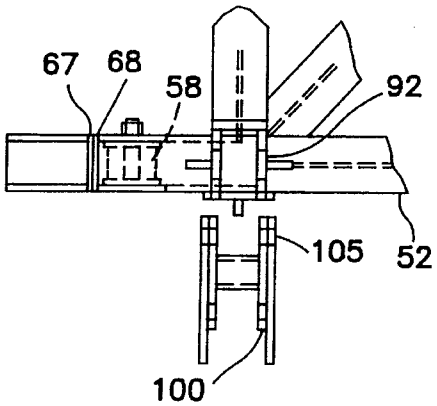
FIG. 22 is a plan view in cross-section partly broken away of FIG. 21.

Cooperative upstanding flanges 96*a* and 96*b* are secured to the top of dolly 56 as best shown in FIGS. 20 and 22. The upstanding flanges are spaced apart sufficiently to receive the pair of fingers 88,88 as shown in FIG. 20. For ease of installation one of the upstanding flanges 96, as shown at 96*b*, is flared at the top at 96*c*. When the fingers 88,88 have dropped into place between the flanges 96*a* and 96*b*, their downward movement is limited by the top of the dolly 56 at which time the bore hole 92 in the fingers 88,88 coincide with similar bores 98 in the upstanding flanges 96 so that the tower section assembly can be pinned by a suitable pin such as 94 to temporarily hold the tower section assembly 86-A1 to the dolly.

After the tower section assembly 86 with the tower section T1 as shown in FIG. 4 is secured to the dolly 56, the dolly 56 is rolled on the guide tracks 52 so that the tower section assembly 86-A1 with the tower section T1 and flare pipe section P1 passes through the opening 48 until the dolly strikes the limit stop 66. At this point, the tower section assembly will be directly over point C and directly below the open top of the bottom section 38.

Figure 24:
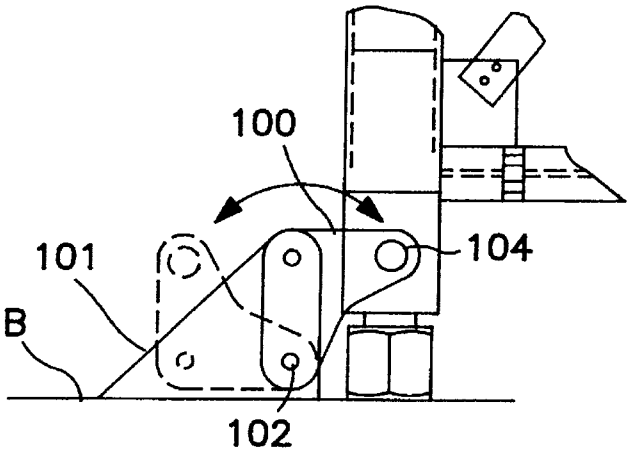
FIG. 24 is a view similar to that of FIG. 21 but showing the latch assembly in a latched position.
Figure 25:
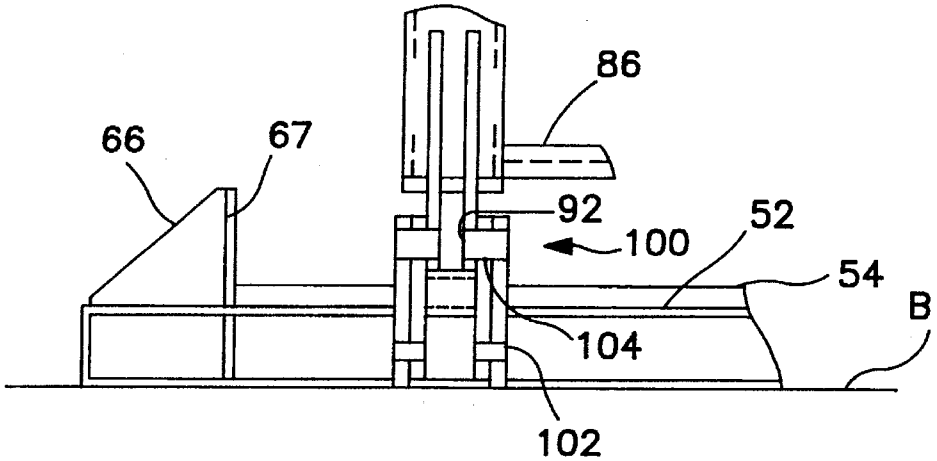
FIG. 25 is a side view of FIG. 24 and partly broken away.

To secure both the tower section assembly 86 and the dolly 56 to the base B, a mast section tie down latch 100 pivoting about stationary pin bracket 101 is provided. This tie down latch is shown in the unlatched position FIG. 21 and in the latched position in FIG. 24 with the unlatched position shown in phantom lines. The tie down latch is in the form of an L-shaped latch pivoted about axis 102 so that the bore 92 of the depending fingers 88,88 would coincide with the bore 104 on the other leg of the latch whereby a suitable pin such as 94 would be able to secure the tower section assembly 86 relative to the base B.

It should be noted that the temporary tie down latch assembly 100 is used only when the tower section assembly 86 is positioned on the dolly 56 and the dolly 56 with the tower section assembly mounted thereon is properly positioned within the bottom section 36.

When properly positioned, latched and lifting blocks 40 secured, the pinning of the tower section assembly 86 to the dolly through bores 92 may be released, freeing the tower section assembly to be telescopically raised. The lifting blocks 40 secured in the conventional manner to the bottom of the tower section assembly 86, permit the tower section assembly to be telescopically raised to the position shown in FIG. 1C so that it is sufficiently high enough to permit the next tower section T2 and accompanying flare pipe section P2 in the tower section assembly 86-A2 to follow. As soon as the tower section T1 has been sufficiently raised, tower section assembly 86-A2 travels on the dolly 56 into the position originally taken by tower section assembly 86-A1 where again the limit stops for the dolly 66 are operative.

Figure 15:
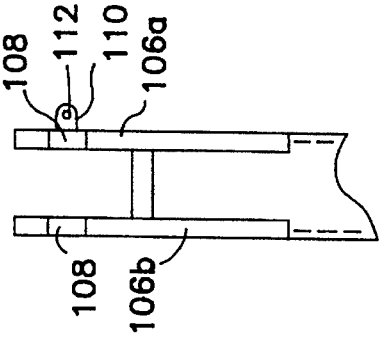
FIG. 15 is a cross-sectional view partly broken away taken along lines 15—15 of FIG. 8.
Figure 12:
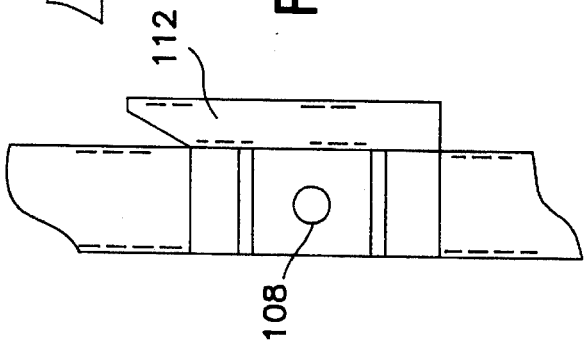
FIG. 12 is a fragmentary cross-sectional view taken along lines 12—12 of FIG. 10 and illustrating the section guides.

At this time tower section T1 should be immediately superposed over tower section T2 particularly as shown in FIGS. 15 and 16. At the top of tower section T2, complementary upwardly raised fingers 106*a* and 106*b* are positioned each of which have mutually aligned bores 108. Finger 106*a* is provided with a pin keeper tab 110 to fit a complementary pin in the bore 112 in the pin keeper tab 110 that will align with a similar opening in keeper pin 94 to maintain the pin 94 in position. To facilitate the alignment of the depending fingers 88,88 into the spaced fingers 106*a* and 106*b* that extend upwardly, section guides 112 may be provided at each of the four corners as shown in FIG. 12.

Once the tower section assemblies A1 and A2 are pinned in accordance with the pin connections arrangements described in regard to FIGS. 15, 16 and 17 and as shown in FIG. 1C, the tower section assemblies A1 and A2 are raised using the winch 42 and lifting blocks 40 connected to the bottom of the tower section assembly A2. The dolly 56 may then be removed along the guide track 52 from beneath the bottom section 36. The tower section assemblies A1 and A2 are now lowered to contact the base B and assume the position as shown in FIG. 7.

Figure 7:
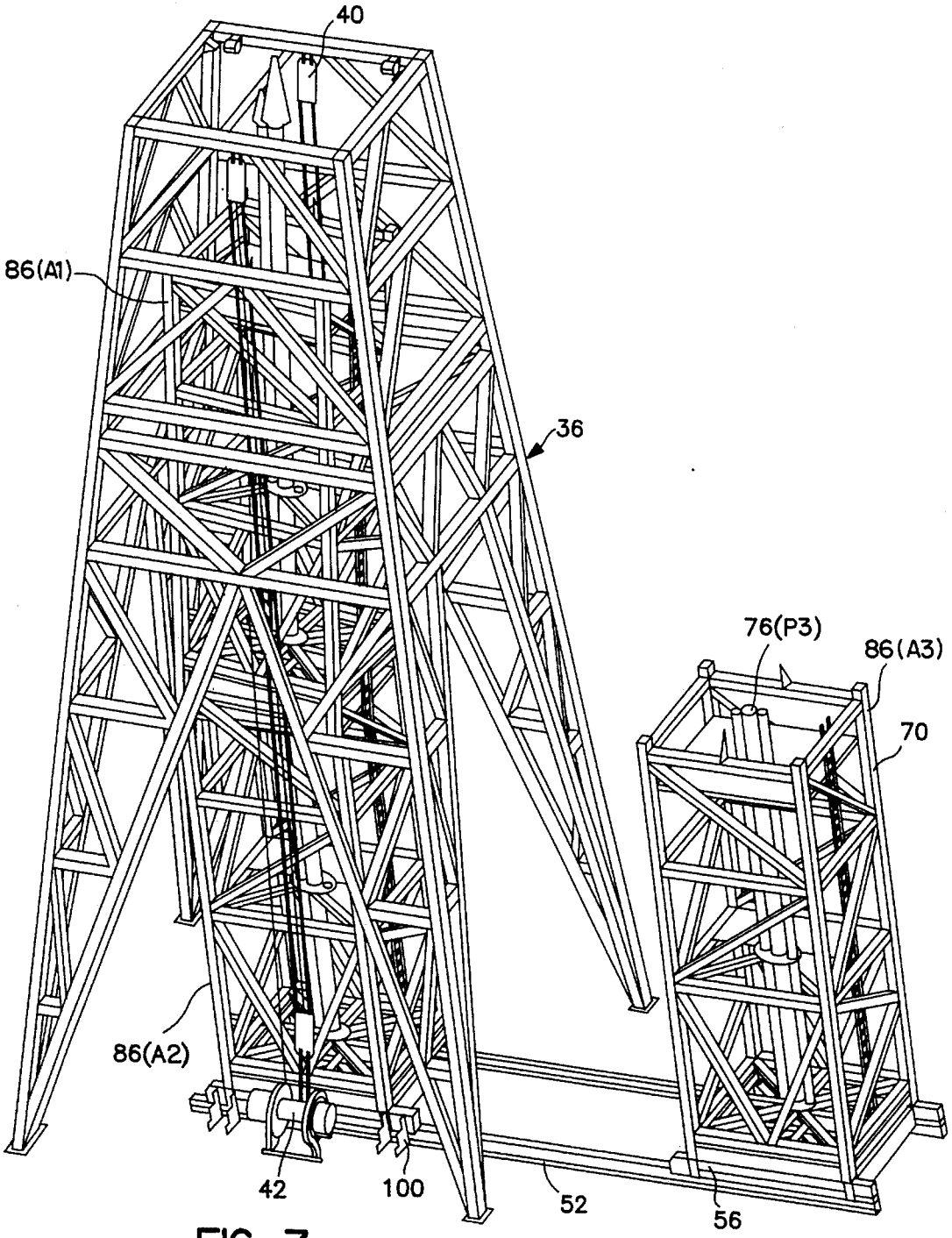
FIG. 7 is a perspective view similar to that of FIG. 6 but illustrating intermediate mast section T2 installed within bottom section and connected to top mast section T1 and the dolly having been removed from the mast section T2 along the guide tracks to receive the next intermediate mast section T3.
Figure 10:
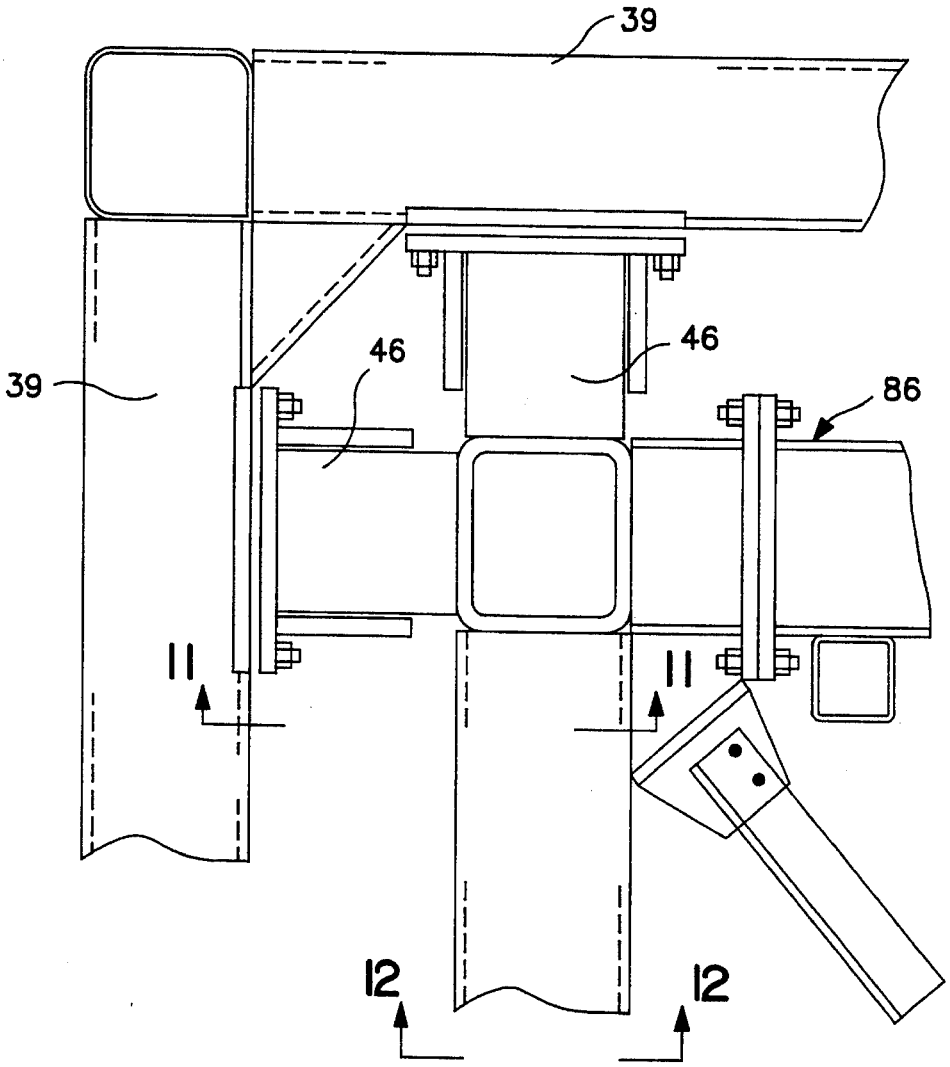
FIG. 10 is a cross-sectional view taken along lines 10—10 of FIG. 8 and partly broken away illustrating the rollers on the bottom section for assisting the telescopic movement of the mast section assemblies.
Figure 11:
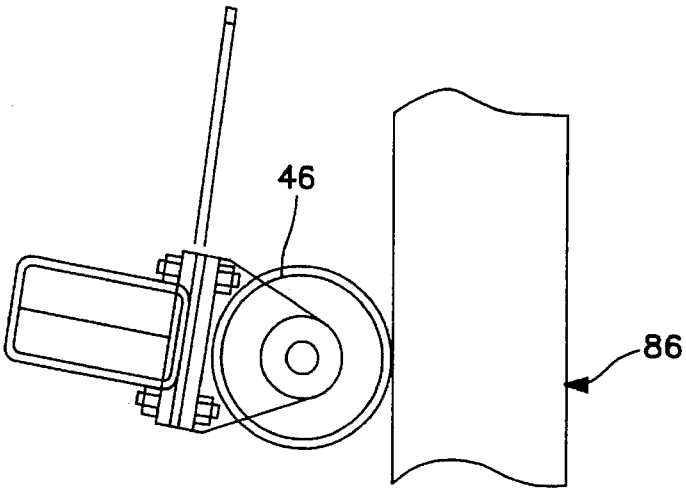
FIG. 11 is a fragmentary side view taken along lines 11—11 of FIG. 10 and illustrating the guide roller arrangement and its contact with the mast section assembly.
Figure 26:
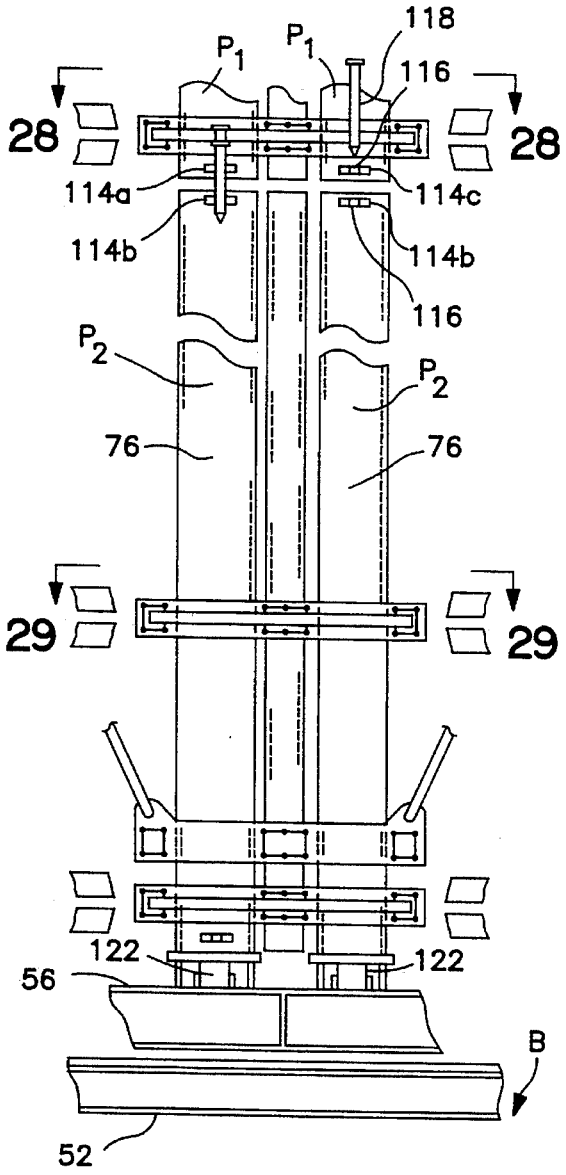
FIG. 26 is an elevational view partly broken away of the flare pipe section and flare pipe support illustrating the gap between the flare pipe prior to upward adjustment by the hydraulic jacks and also illustrating in the flare pipe on the left the dowel pin engaging the guide tabs while on the right the dowel pin has not yet descended into the opening in the guide tabs.

In the position shown in FIG. 7 the flare pipe sections 76-P1 and P2 are not welded together and in fact are spaced slightly from each other to form a gap G between these pipes as shown in FIG. 26. Also as shown in FIG. 26 as well as FIG. 27 a pair of opposed guide tabs 114*a* and 114*b* is provided with suitable aligned bores 116. The flare pipe sections P1 and P2 may be aligned by use of a dowel pin 118 that passes through complementary bores 120 on each side of the opening 85 in the plate 81 as shown in FIG. 28. The dowel pin 118 can be dropped into the bore 116 of the guide tabs 114*a* and 114*b* as shown in the flare pipe section P2 on the right hand side of FIG. 26. The dowel pin 118 has been previously dropped through the guide tabs 114*a* and 114*b* in the flare pipe section P2 on the left hand side of FIG. 26.

Figure 27:
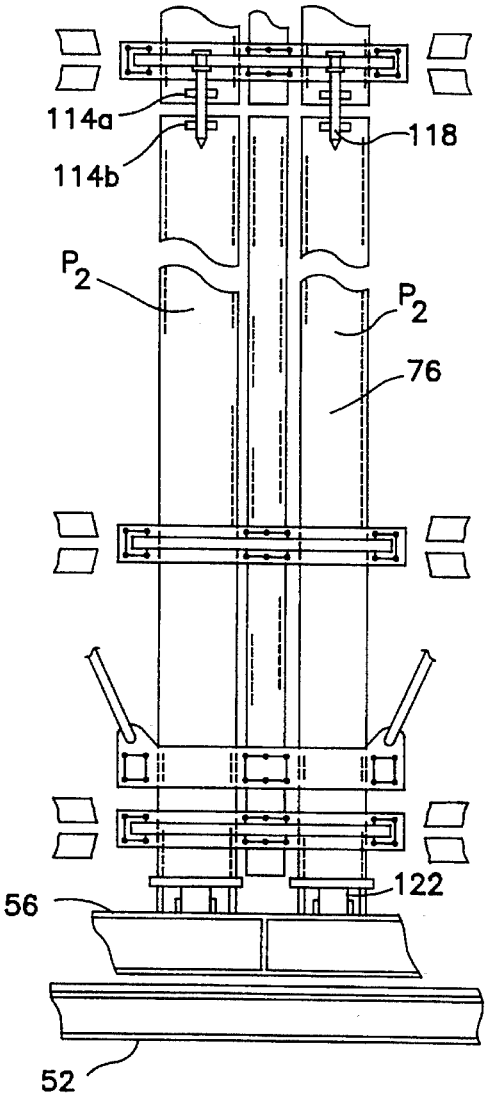
FIG. 27 is an elevational view partly broken away similar to FIG. 26 in which the hydraulic jacks have been actuated to raise the flare pipe sections sufficiently to close the gap between the pipe sections in order to permit the pipe sections to be welded.

In the position as shown in FIG. 26, the flare pipe sections P1 and P2 are aligned but as yet not connected. In order to close the gap G between the pipes, a jack that may be hydraulic or pneumatic is shown in FIG. 26 beneath the flare pipe section P2. Activation of the jack moves the flare pipe section P2, as shown in FIG. 27, up to the point where the flare pipe sections may be welded.

Figure 2E:
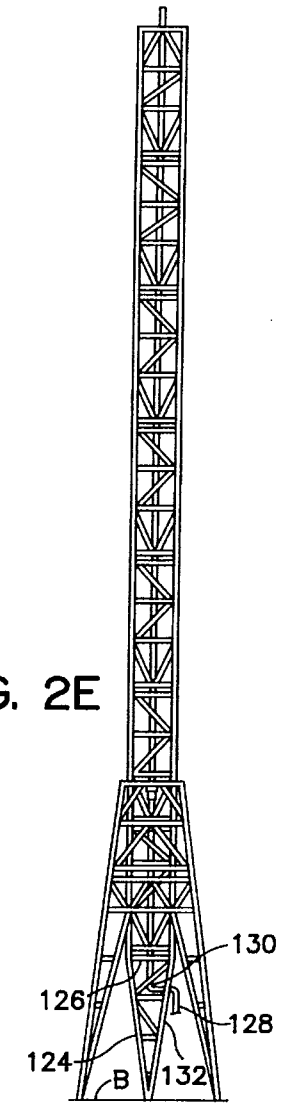
FIG. 2 is a view similar to that of FIG. 1 showing the completion of the sequence for the erection of the flare pipe tower.
Figure 2D:
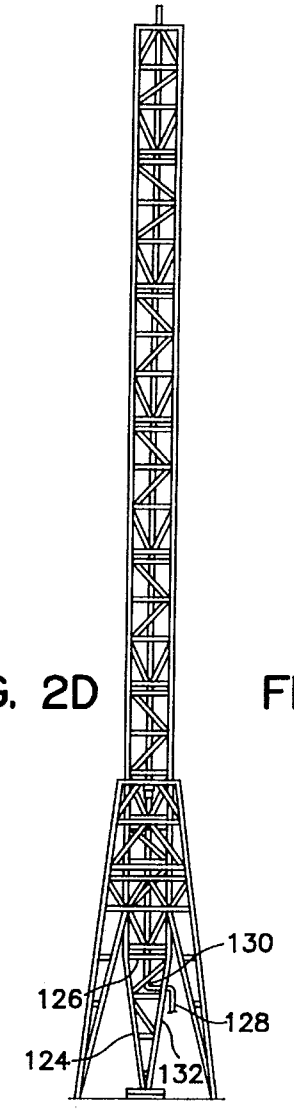

After the weldments are accomplished additional tower section assemblies A3, A4, A5, etc. with included tower sections T3, T4, T5, etc. and flare pipe sections P3, P4 and P5 are serially added to proceed from the showing at FIG. 1D through the completed construction in FIG. 2D and 2E except for the lower section shown in FIGS. 2D and 2E.

Figure 2C:
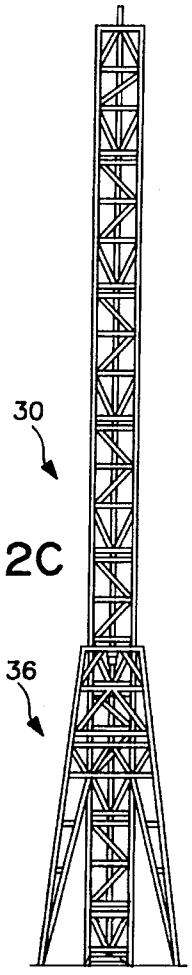
Figure 2B:
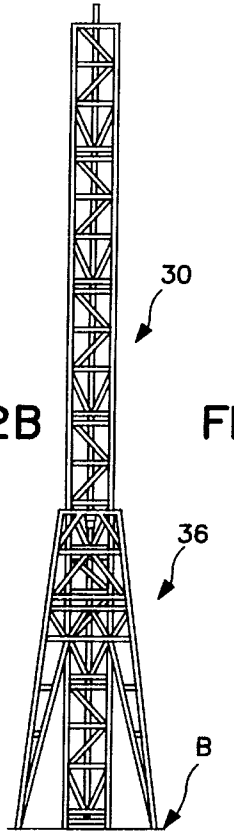
Figure 2A:
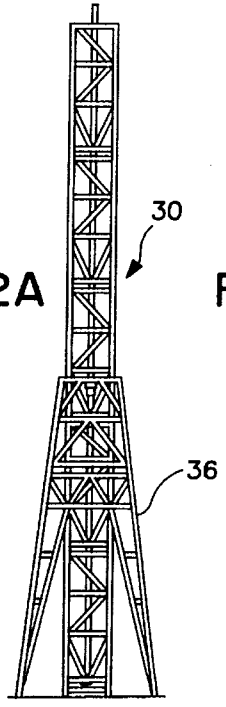
Figure 3:
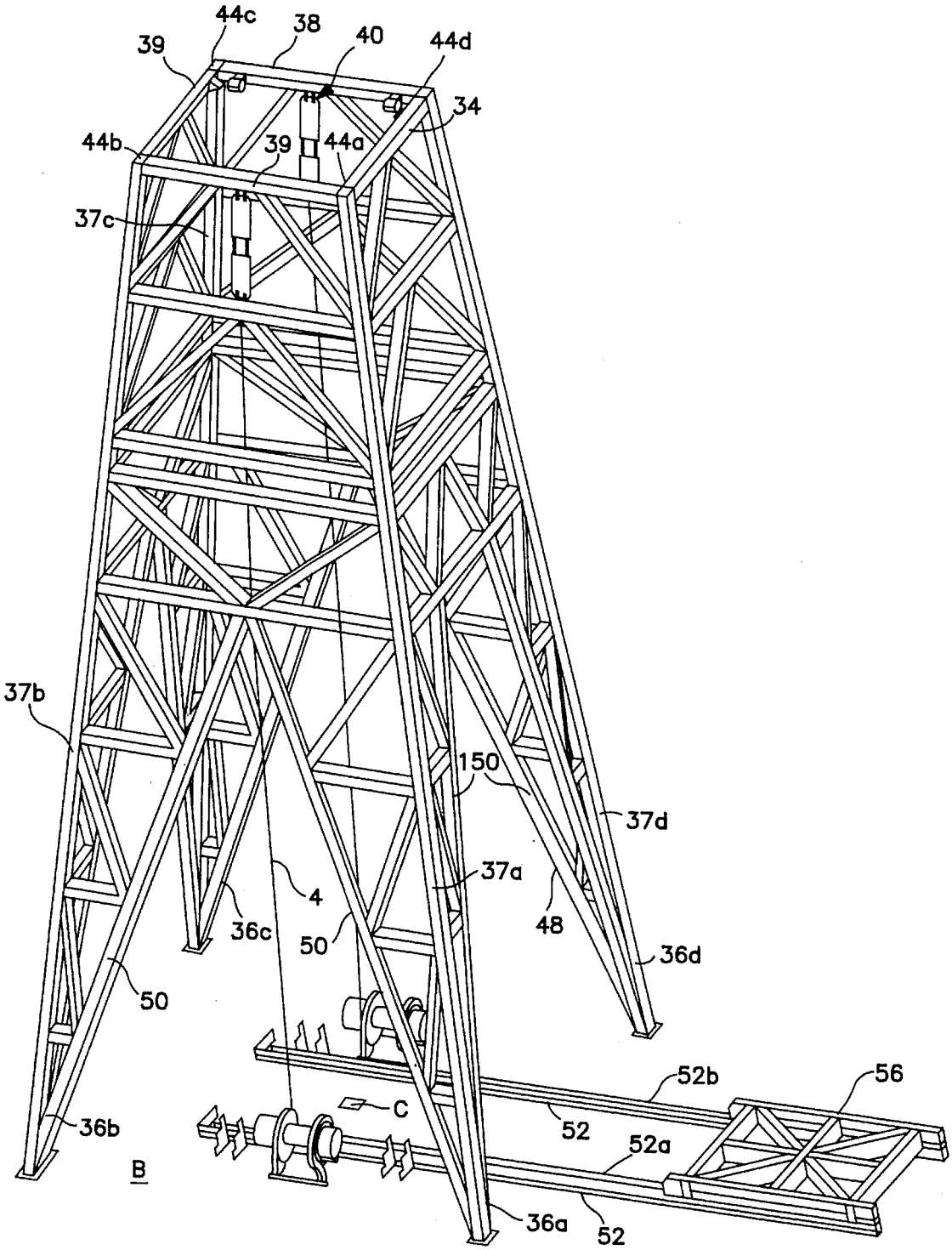
FIG. 3 is a perspective view of the bottom section showing the V-shaped opening or door on at least one side and the guide tracks upon which the dolly moves into and out of position beneath the bottom section.

In the sequence of construction up to essentially FIG. 2C wherein numerous tower section assemblies have been serially added and the tower sections and pipe sections pinned or welded as required, another feature of the present invention is evident. Particularly as shown in FIG. 3. Following the raising of each of the tower section assemblies 86 a final lower section 124 is added which is different than any of the previous tower section assemblies.

Figure 30:
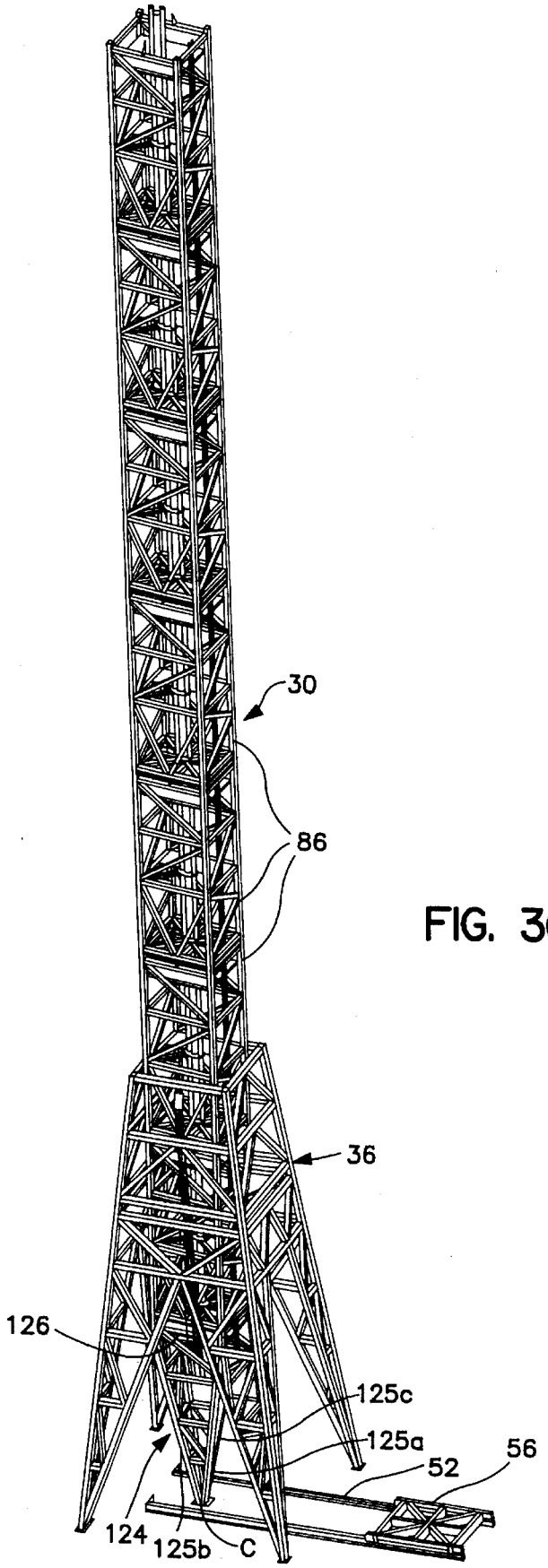
FIG. 30 is a perspective view of the erected flare pipe tower.

As shown in FIG. 30 the lower section 124 is composed of 4 angled legs 125*a*, 125*b*, 125*c* and 125*d* that extend downwardly from the top 126 of the lower section that is essentially coextensive and within the four corners of the last tower section to be added but instead of being vertically dependent and in line with previous tower section legs 72*a* through 72*b*, the legs 125*a* through 125*d* are angled downwardly to meet essentially at a point that would be in the proximity of point C on the ground or on the deck. It is intended that the weight of the tower or tower 30 with each of the tower section assemblies 86 connected together would be supported by the lower section 124 and its approximate contact point C.

As should be manifest the construction as described provides a fifth leg of vertical weight support for the flare pipe tower. In addition to each of the legs 36*a* through 36*d* of the bottom section a fifth leg equivalent provided by the converging of the legs 125*a* through 125*d* for supporting the weight of the column of tower section assemblies provides additional support not previously attainable in prior art constructions. The legs 36*a* through 36*d* of the bottom section 36 provide wind stability against lateral movement or tipping while the principal weight of the tower of the present invention is supported by the generally trapezoidally or conically shaped lower section 124.

It is obviously not necessary that the converging legs 125*a* through 125*d* meet at any point such as C or that these legs are continuous and aligned but the closer they do come together the more room there is for worker access beneath the bottom section 36. In any event it is believed that the converging of these legs provides a cross-sectional area of their contact with the base B that is significantly smaller (at least less than 50%–85%) in cross-sectional area than the top 126 of the lower section 124 and particularly the tower section assemblies. While not critical, this convergence is of significant benefit to those beneath the tower.

The riser pipe 128 shown in FIGS. 2D and 2E containing the gases to be burned may be connected to the bottom of the completed flare pipe 32 that may extend below the bottom of the last tower section assembly to be raised or the top 126 of the lower section 124. A saddle (not shown) may be used to hold the riser pipe vertical, if desired, but that construction forms no part of the present invention.

In view of the foregoing it is believed that the objects of the present invention have been achieved and that the scope of the present invention should be limited solely by the appended claims in which we claim:

1. A telescopic flare pipe tower for establishing a vertical positioned flare pipe above a base comprising:

a bottom section in contact with said base and having a plurality of sides at least one of said sides being open to receive additional sections, a plurality of tower section assemblies each including a tower section serially received within said opening and telescopically raised above said bottom section, each of said tower section assemblies having mutual connecting means between adjacent tower section assemblies to secure said tower section assemblies together above said bottom section, each of said tower section assemblies also including a flare pipe section contained therein, at least one securing means connected to each said tower section assembly for holding each said pipe section from selected movement relative to said tower section, whereby upon serial telescopic erection of said tower section assemblies and mutual connecting of said tower sections, said pipe sections are serially connected to form a flare pipe.

2. The construction of claim 1 including, a lower tower section received within said bottom section, means for connecting the top of said lower tower section to the bottom of an adjacent tower section, said lower tower section being in contact with said base to provide support for the tower formed from the connected tower sections.

3. The construction of claim 2 including, said lower tower section having horizontal cross-sections subscribing substantially less area than that of the top of said lower tower section whereby to provide more free and unobstructed area within the bottom section at the base.

4. The construction of claim 2 including, said lower tower section being shaped to substantially lessen the horizontal cross-sectional area of the lower tower section at the base level compared to the cross-sectional area of the top of said lower tower section.

5. The construction of claim 1 including, said securing means for said pipe sections limiting lateral movement of said pipe sections while permitting selected vertical movement within said tower section.

6. The construction of claim 1 including, a lower tower section received within said bottom section, means for connecting the top of said lower tower section to the bottom of said last previously telescoped tower section, said lower tower section being in contact with said base to provide support for the tower formed from the connected tower sections, and said securing means for said pipe sections limiting lateral movement of said pipe sections while permitting selected vertical movement within said tower sections.

7. The construction of claim 1 including, rollers positioned within said bottom section to provide rolling contact within said tower sections being telescoped upwardly.

8. The construction of claim 1 including, alignment means secured to the top and bottom of each said pipe section prior to telescoping a pipe section for permitting the axial alignment of said pipe sections prior to welding.

9. The construction of claim 8 including, said alignment means including guide tabs having a hole therein for receiving a guide dowel pin to secure the alignment of said pipe sections.

10. The construction of claim 5 including, said securing means including an opening to receive said pipe section for sliding axial movement relative to said tower section.

11. The construction of claim 10 including, said opening being of a diameter larger than that required for sliding movement of said pipe section to accommodate the thermal expansion of said flare pipe.

12. The construction of claim 1 including, a lower tower section received within said bottom section, means for connecting the top of said lower tower section to the bottom of an adjacent tower section, said lower tower section being in contact with said base to provide support for the tower formed from the connected tower sections, said securing means for said pipe sections limiting lateral movement of said pipe sections while permitting selected vertical movement within said tower sections, and said securing means including an opening to receive said pipe section for sliding axial movement relative to said tower section.

13. The construction of claim 1 including, a lower tower section received within said bottom section, means for connecting the top of said lower tower section to the bottom of an adjacent tower section, said lower tower section being in contact with said base to provide support for the tower formed from the connected tower sections, said lower tower section being shaped to substantially lessen the horizontal cross-sectional area of the lower tower section at the base level compared to the cross-sectional area of the top of said lower tower section, said securing means for said pipe sections limiting lateral movement of said pipe sections while permitting selected vertical movement within said tower sections, said securing means including an opening to receive said pipe section for sliding axial movement relative to said tower section, and said opening being of a diameter larger than that required for sliding movement of said pipe section to accommodate the thermal expansion of said flare pipe.

14. The apparatus for construction of the telescopic flare pipe of claim 1 including, a track extending on the base level from within the bottom section to beyond the bottom section, a dolly for travelling on said track and for transporting a tower section assembly to and within the bottom section to be telescoped upwardly.

15. The apparatus of claim 14 including, tie down means securing the bottom of said tower section assembly to the dolly.

16. The apparatus of claim 14 including, pipe section raising means positioned on said apparatus for raising the pipe section relative to the last tower section assembly received within said bottom section and sliding said pipe section within the securing means connected to the tower section assembly.

17. The apparatus of claim 16 including, said pipe section raising means being a jack mounted on said dolly for contact with said pipe section to be raised for welding contact with the superpositioned pipe section.

18. The apparatus of claim 14 including, a tie down latch assembly secured to said base for securing said tower section assembly relative to said base prior to being telescoped upwardly and a limit stop positioned for contact with said dolly to limit the travel of said dolly.

19. The apparatus of claim 14 including, pipe section raising means positioned on said apparatus for raising the pipe section relative to the last tower section assembly received within said bottom section and sliding said pipe section within the securing means connected to the tower section assembly, a tie down latch assembly secured to said base for securing said tower section assembly relative to said base prior to being telescoped upwardly and a limit stop positioned for contact with said dolly to limit the travel of said dolly.

20. The apparatus of claim 14 including, tie down means securing the bottom of said tower section assembly to the dolly, pipe section raising means positioned on said apparatus for raising the pipe section relative to the last tower section assembly received within said bottom section and sliding said pipe section within the securing means connected to the tower section assembly, said pipe section raising means being a jack mounted on said dolly for contact with said pipe seciton to be raised for welding contact with the superpositioned pipe section, a tie down latch assembly secured to said base for securing said tower section assembly relative to said base prior to being telescoped upwardly and a limit stop positioned for contact with said dolly to limit the travel of said dolly.

21. The method of erecting a telescopic flare pipe tower comprising:

providing a bottom section on a base, providing said bottom section constructed with at least one open side, and an open top to permit receipt of tower sections, laying a track on said base and into said open side, providing a dolly for travelling on said track from a point distal to said bottom section to a point within said open side, providing a first tower section for telescoping up above said bottom section, installing a first pipe section within said tower section to form a first tower section assembly, mounting said first tower section assembly onto said dolly positioned on said track, transporting said first tower section assembly on said dolly through said open side and into position below said open top, telescoping said first tower section assembly upwardly through said open top, holding said first tower section assembly at a raised position, withdrawing said dolly on said track, mounting a second tower section assembly including a second pipe section within a second tower section on said dolly, transporting said second tower section on said dolly through said open side and into position below said first tower section assembly, connecting said second tower section to said first tower section, connecting said second pipe section to said first pipe section to form a flare pipe serially adding further tower section assemblies to form an extended flare pipe within a tower structure, connecting a gas pipe to the last pipe section to be added to form said flare pipe.

22. The method of claim 21 including, installing a lower section beneath the last previous tower section assembly to be telescoped upwardly from the bottom section, connecting said lower section to said last previous tower section of said last previous tower section assembly, supporting said lower section on said base to provide vertical support for the superposed tower sections.

23. The method of claim 21 including, providing lateral support for said flare pipe sections in said tower sections, permitting vertical movement of movable flare pipe sections relative to said lateral support within the respective said tower section.

24. The method of claim 22 including, raising said second pipe section relative to said tower section toward the first pipe section for connection thereto to form a flare pipe.

25. The method of claim 24 including, said raising of said second pipe section being by a hydraulic jack positioned between said dolly and said second pipe section.

26. The method of claim 21 including, installing a lower section beneath the last previous tower section assembly to be telescoped upwardly from the bottom section, connecting said lower section to said last previous tower section of said last previous tower section assembly, supporting said lower section on said base to provide vertical support for the superposed tower sections, providing lateral support for said flare pipe sections in said tower sections, permitting vertical movement of movable flare pipe sections relative to said lateral support within the respective said tower section.

27. The method of claim 21 including, installing a lower section beneath the last previous tower section assembly to be telescoped upwardly from the bottom section, connecting said lower section to said last previous tower section of said last previous tower section assembly, supporting said lower section on said base to provide vertical support for the superposed tower sections, providing lateral support for said flare pipe sections in said tower sections, permitting vertical movement of movable flare pipe sections relative to said lateral support within the respective said tower section, and raising said second pipe section relative to said tower section toward the first pipe section for connection thereto to form a flare pipe.

28. The method of claim 21 including, installing a lower section beneath the last previous tower section assembly to be telescoped upwardly from the bottom section, connecting said lower section to said last previous tower section of said last previous tower section assembly, supporting said lower section on said base to provide vertical support for the superposed tower sections, providing lateral support for said flare pipe sections in said tower sections, permitting vertical movement of movable flare pipe sections relative to said lateral support within the respective said tower section, raising said second pipe section relative to said tower section toward the first pipe section for connection thereto to form a flare pipe, and said raising of said second pipe section being by a hydraulic jack positioned between said dolly and said second pipe section.

29. The method of erecting a telescopic flare pipe tower comprising:

providing a bottom section on a base, providing said bottom section constructed with at least one open side, and an open top to permit receipt of tower sections, providing a first tower section, installing a first pipe section within said tower section to form a first tower section assembly, installing said first tower section assembly within said bottom section, holding said first tower section assembly at a raised position, installing a second tower section assembly including a second pipe section within a second tower section below said first tower assembly, connecting said second tower section to said first tower section, connecting said second pipe section to said first pipe section to form a flare pipe, serially adding and raising further tower section assemblies to form an extended flare pipe within a tower structure.

30. The method of claim 29 including, raising said tower section assemblies telescopically above said bottom section.

31. The method of claim 29 including, transporting said second tower assembly within said bottom section on a dolly riding on a track.

32. The method of claim 29 including, installing a lower section beneath the last previous tower section assembly to be telescoped upwardly from the bottom section, connecting said lower section to said last previous tower section of said last previous tower section assembly, supporting said lower section on said base to provide vertical support for the superposed tower sections.

33. The method of claim 29 including, providing lateral support for said flare pipe sections in said tower sections, permitting vertical movement of movable flare pipe sections relative to said lateral support within the respective said tower section.

34. The method of claim 29 including, installing a lower section beneath the last previous tower section assembly to be telescoped upwardly from the bottom section, connecting said lower section to said last previous tower section of said last previous tower section assembly, supporting said lower section on said base to provide vertical support for the superposed tower sections, providing lateral support for said flare pipe sections in said tower sections, permitting vertical movement of movable flare pipe sections relative to said lateral support within the respective said tower section.

35. The method of claim 29 including, installing a lower section beneath the last previous tower section assembly to be telescoped upwardly from the bottom section, connecting said lower section to said last previous tower section of said last previous tower section assembly, supporting said lower section on said base to provide vertical support for the superposed tower sections, and raising said second pipe section relative to said tower section toward the first pipe section for connection thereto to form a flare pipe.

36. The method of claim 29 including, installing a lower section beneath the last previous tower section assembly to be telescoped upwardly from the bottom section, connecting said lower section to said last previous tower section of said last previous tower section assembly, supporting said lower section on said base to provide vertical support for the superposed tower sections, providing lateral support for said flare pipe sections in said tower sections, permitting vertical movement of movable flare pipe sections relative to said lateral support within the respective said tower section, and raising said second pipe section relative to said tower section toward the first pipe section for connection thereto to form a flare pipe.

* * * * *